United States Patent [19]

Svyatsky et al.

[11] Patent Number: 4,573,675

[45] Date of Patent: Mar. 4, 1986

[54] DOCUMENT FEEDER

[75] Inventors: Eduard Svyatsky, Chicago; K. George Rabindran, Morton Grove; Thomas J. Faber, Skokie, all of Ill.

[73] Assignee: Bell & Howell Company, Chicago, Ill.

[21] Appl. No.: 736,012

[22] Filed: May 20, 1985

[51] Int. Cl.[4] ..... B65H 3/52

[52] U.S. Cl. ..... 271/122; 271/125

[58] Field of Search ..... 271/121, 122, 125

[56] References Cited

U.S. PATENT DOCUMENTS 749,986 1/1904 Dick ..... 271/122

3,991,998 11/1976 Banz ..... 271/125

4,147,341 4/1979 Wurscher ..... 271/122

*Primary Examiner*—Richard A. Schacher

*Attorney, Agent, or Firm*—Alan B. Samlan; Alan H. Haggard; Neal C. Johnson

[57] ABSTRACT

A device for feeding envelopes from a hopper to an envelope processing station. Driving and driven rollers feed the envelopes one at a time from the hopper. The rollers define a nip through which the envelopes are fed. A unique "U" shaped spring forces the driven roller to contact the driving roller causing the driven roller to oscillate when no envelopes are fed. The oscillation helps envelope feeding by pulling and separating the lead envelope from the stack.

8 Claims, 3 Drawing Figures

DOCUMENT FEEDER

BACKGROUND AND SUMMARY OF THE INVENTION

This invention relates to document feeders and more particularly to an envelope feeder used to transport documents from an envelope tray or hopper to a document processing location. This invention is related to co-pending application Ser. No. 650,926 filed Sept. 14, 1984, entitled Demand Document Feeder and assigned to the same assignee as this application (hereinafter the '926 application).

There are many instances of applications which require envelopes in a stack to be transported from a hopper to an envelope reading station or to envelope processing equipment. The '926 application illustrates one such example where envelopes are transported from the hopper to an envelope reading position where the operator reads the zip code and keys it into a computer by means of a keyboard. The operator then advances the envelope to a zip code printing station where a bar code is printed on the envelope which corresponds to the zip code entered by the operator. The '926 application illustrates an improved demand document feeder for accomplishing the feeding of the envelopes from the hopper to the reading position.

A problem with the device shown in the '926 application is its difficulty in feeding thick, rigid or heavy envelopes as they tend to push the lower driven roller of the first set of feed rollers away from the driving roller. The envelope is not bent around the driving roller a sufficient amount to force the envelope into the nip. The force from the drive roller applied through the envelope to the driven roller is insufficient to overcome the brake force applied to the driven roller. The brake is used to separate two or more confronting documents such that only one document is fed through the nip at a time. With the driving roller rotating, and the envelope not being forced into the nip, the heavy envelope merely pushes the driven roller away from the drive roller without being fed into the nip so that a stalled condition is present.

Applicant's invention overcomes the problem of the feeder illustrated in the '926 application. By changing the angle at which the documents are fed, and providing a uniquely designed spring and roller assembly, applicant has devised a means to feed documents regardless of their thickness, rigidity or weight. A drive roller is driven by a motor through a one-way clutch. The driven roller has a brake mechanism which retards its rotation. The force applied by the drive roller is sufficient to overcome the brake force so that the driven roller will rotate in an envelope feed direction when it contacts the drive roller. Just as in the '926 application, when a single envelope is in the nip, the force from the drive roller will overcome the brake force applied to the driven roller causing the envelope to be fed through the nip. In the improved design disclosed herein, the envelopes are fed in a nearly straight-through path with the envelope only being slightly bent around the drive roller.

The braking force minimizes the possibility of two documents being fed through the nip at the same time by stopping the second envelope until the first envelope clears the nip. Just as in the '926 application, there is a second set of drive and driven rollers positioned downstream of the first set to give added assurance of feeding only one envelope at a time and to hold the envelope with a portion of it extending into the document reading position.

There is an inverted "U" shaped spring with one arm of the "U" shaped spring mounted to the feeder frame. The other end of the "U" shaped spring is mounted to the shaft of the driven roller. The design of the spring causes the driven roller to quickly oscillate when there is no document in the nip. This oscillation causes the stack of documents to be lightly pulled aiding in the envelope feeding. When an envelope enters the nip, the oscillation immediately stops and the driven roller separates from the drive roller by means of the "U" shaped spring. The force from the drive roller is transmitted through the document to the driven roller just as in the prior design feeder. However, with the uniquely designed "U" shaped spring, thick documents will still enter the nip a sufficient amount to cause the force from the drive roller to be transmitted through the document to the driven roller without stalling. As soon as a document clears the nip, the oscillation begins again.

There is a second set of drive and driven rollers located downstream of the first set just as in the prior device. The second set of rollers rotate at a greater speed than the first set to provide a gap between documents as they are fed. There is an improved lower driven roller design to also use a unique spring which helps hold heavier documents more effectively.

Accordingly, an object of the invention is to provide an envelope feeding device that has an oscillating roller mechanism to aid in separating and feeding envelopes. Related to this is the object of providing an oscillating mechanism which only oscillates when an envelope is not in the feeding nip with the oscillation stopping when an envelope is being fed.

Another object is to provide an envelope feeder which has two sets of feeding rollers with improved separation mechanisms to only permit one document to be fed at a time. Still another object is to provide an envelope feeder which has roller separation means which operate responsive to the thickness of the document being fed to accommodate various size envelopes yet apply the proper force to feed or hold the envelope as desired.

Yet another object is to provide an envelope feeder that feeds the envelopes at an angle that subjects the envelope to minimum bending around the drive roller and allows straight-through envelope feeding.

Many other objects and advantages of the invention will be apparent from the following description of the drawings.

DETAILED DESCRIPTION OF THE PREFERRED EMBODIMENT

Reference is now made to the co-pending application Ser. No. 650,926 filed Sept. 14, 1984 which is incorporated herein by reference. The '926 application illustrated a document feeder which employed a pair of drive rollers mounted on a first drive shaft. These rollers are mounted to the drive shaft by means of a one-way clutch which allows the drive rollers to rotate only in the forward envelope feeding direction.

Mounted below the drive rollers are a pair of driven rollers. The driven rollers rotate in the envelope feeding direction when an envelope enters the nip defined between the drive and driven rollers. The force of the drive roller is transmitted through the document to the driven roller causing the driven roller to rotate in the envelope feeding direction. A relatively constant braking force is applied to the driven rollers to provide a relatively consent force counter to the force transmitted through the envelope.

Figure 1:
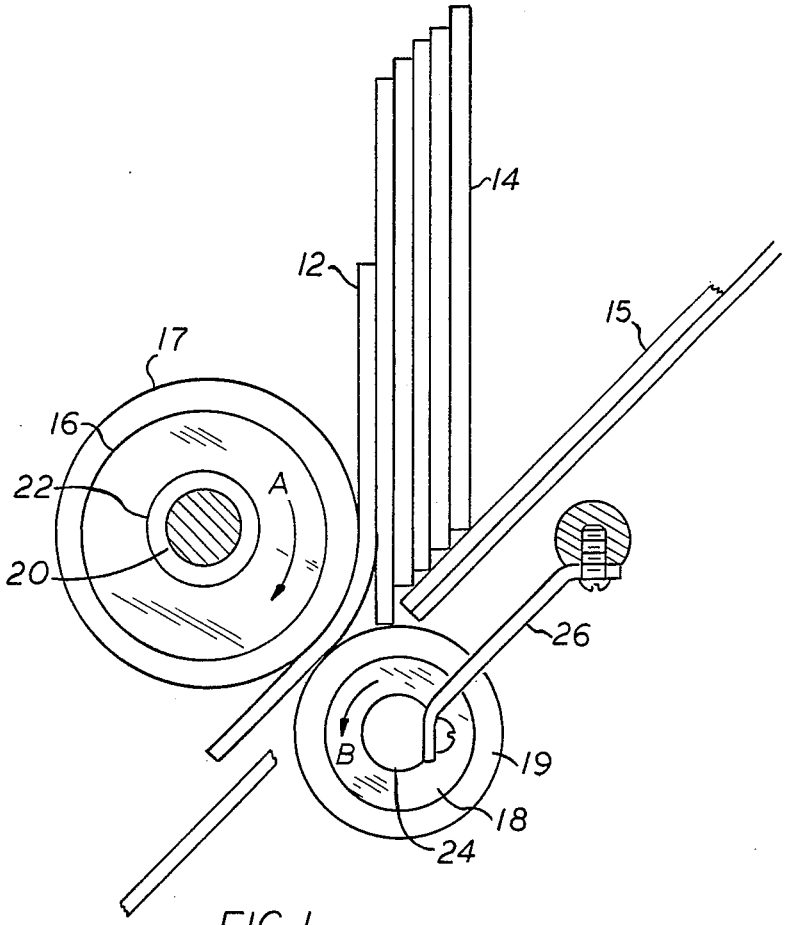
FIG. 1 is a cross sectional side view of the prior art envelope feeding device showing the feeding of envelopes through the first pair of feed rollers.

FIG. 1 illustrates the problems encountered with the '926 document feeder. By examining FIG. 1, it can be seen that an envelope 12 is fed into the feeder from an envelope tray or hopper 15 having a stack of envelopes 14. The lead envelope 12 in the stack 14 is fed into a nip defined between a drive roller 16 and a driven roller 18. The rollers have friction surfaces 17, 19 of rubber or other suitable material to engage and drive the envelope 12. The drive roller 16 is mounted on a drive shaft 20 by means of a one-way clutch 22. The drive shaft 20 is driven by a motor (not illustrated) which is connected to the drive shaft 20 through a mechanical drive system. The driven roller 18 is mounted below the drive roller 16 on a non-rotating stationary shaft 24. A spring member 26 provides a force to maintain the friction surfaces 17, 19 in light contact with each other when no envelope is between them. A brake mechanism (not illustrated) is mounted on the stationary shaft 24 adjacent the driven roller 18. The brake mechanism provides a constant force to the driven roller 18. The force of the brake mechanism is applied in a direction opposite the envelope feed direction. The operation of the brake mechanism is as described in the '926 application and minimizes the possibility of double feeding envelopes.

The problem with the device illustrated in FIG. 1 is that when an extremely thick, rigid or heavy document was fed into the feeder, the angle of entry caused the document to push the driven roller 18 down away from the drive roller 16. The driven roller 18 was permited to pivot away from the drive roller 16 by spring member 26. The rigidity of the document 12 was such that it would not bend or flex around drive roller 16 and enter the nip defined between the drive roller 16 and driven roller 18. With drive roller 16 out of engagement with driven roller 18, the driven roller 18 will not rotate as the brake mechanism holds it stationary. The friction between the friction surface 17 and the envelope 12 is not sufficient to drive and bend the heavy document 12 around the circumference of the drive roller 16 and force it into the nip. In this condition, the bottom edge of the envelope merely rests against the driven roller 18 forcing it away from the drive roller 16, and a stalled condition results. In order to overcome this stall condition the document must enter the nip so that the force of the drive roller 16 is transmitted through the envelope 12 to the driven roller 18 overcoming the brake force causing roller 18 to also rotate in an envelope feed direction.

Figure 2:
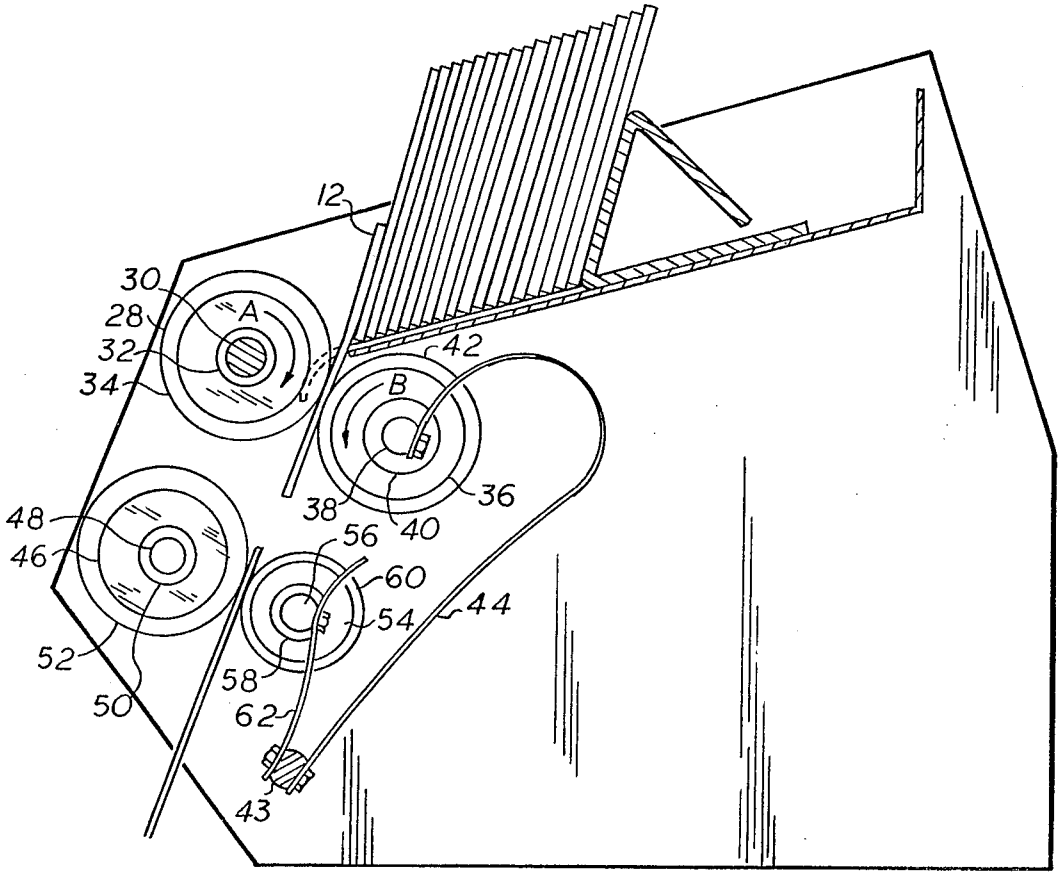
FIG. 2 is a side cross sectional view illustrating the improved spring mechanism used to support each of the driven rollers.

Turning to FIG. 2 applicant's improved feeder is illustrated. A driving roller 28 is mounted on a first driving shaft 30 by means of a one-way clutch 32 just as in the prior device. The driving roller 28 has a friction surface 34 placed around the outside of the driving roller 28. A driven roller 36 is mounted to a stationary shaft 38 with a brake mechanism 40 applying a force to the driven roller 36 in a direction opposite the envelope feed direction. The driven roller 36 has a friction surface 42 around its outer circumference similar to the friction surface 34. The stationary shaft 38 is mounted to a frame member 43 by means of a uniquely designed "U" shaped spring 44. One end of the "U" shaped spring 44 is rigidly attached by conventional means to the frame 43. The other end of the "U" shaped spring 44 is free to oscillate and has the stationary shaft 38 rigidly attached to it.

There is a second set of drive and driven rollers mounted below the top set of rollers. A second driving roller 46 is mounted to a second driving shaft 48 by means of a second one-way clutch 50. A friction surface 52 surrounds the second driving roller 46. The first and second driving shafts 30 and 48 are connected by a drive belt to the motor (not illustrated). The driving shaft 48 is driven at a higher speed than the first driving shaft 30 so that an envelope 12 in the second set of rollers will travel at a greater speed than an envelope in the first set of rollers. This results in a gap between envelopes as they travel through the two sets of rollers.

A second driven roller 54 is mounted to a stationary shaft 56 with a second brake mechanism 58 applying a force counter to the envelope feed direction. There is a friction surface 60 around the outer circumference of the second driven roller 54 which is similar to the friction surfaces around the other rollers. A spring 62 connects the second stationary shaft 56 to the frame 43. The spring 62 applies a force to the second stationary shaft 56 forcing the second driven roller 54 against the second driving roller 46. An upstanding end 64 of the spring 62 extends into the area between the driven roller 36 and second driven roller 54 to aid in keeping any misdirected envelopes from falling into the feeder.

Figure 3:
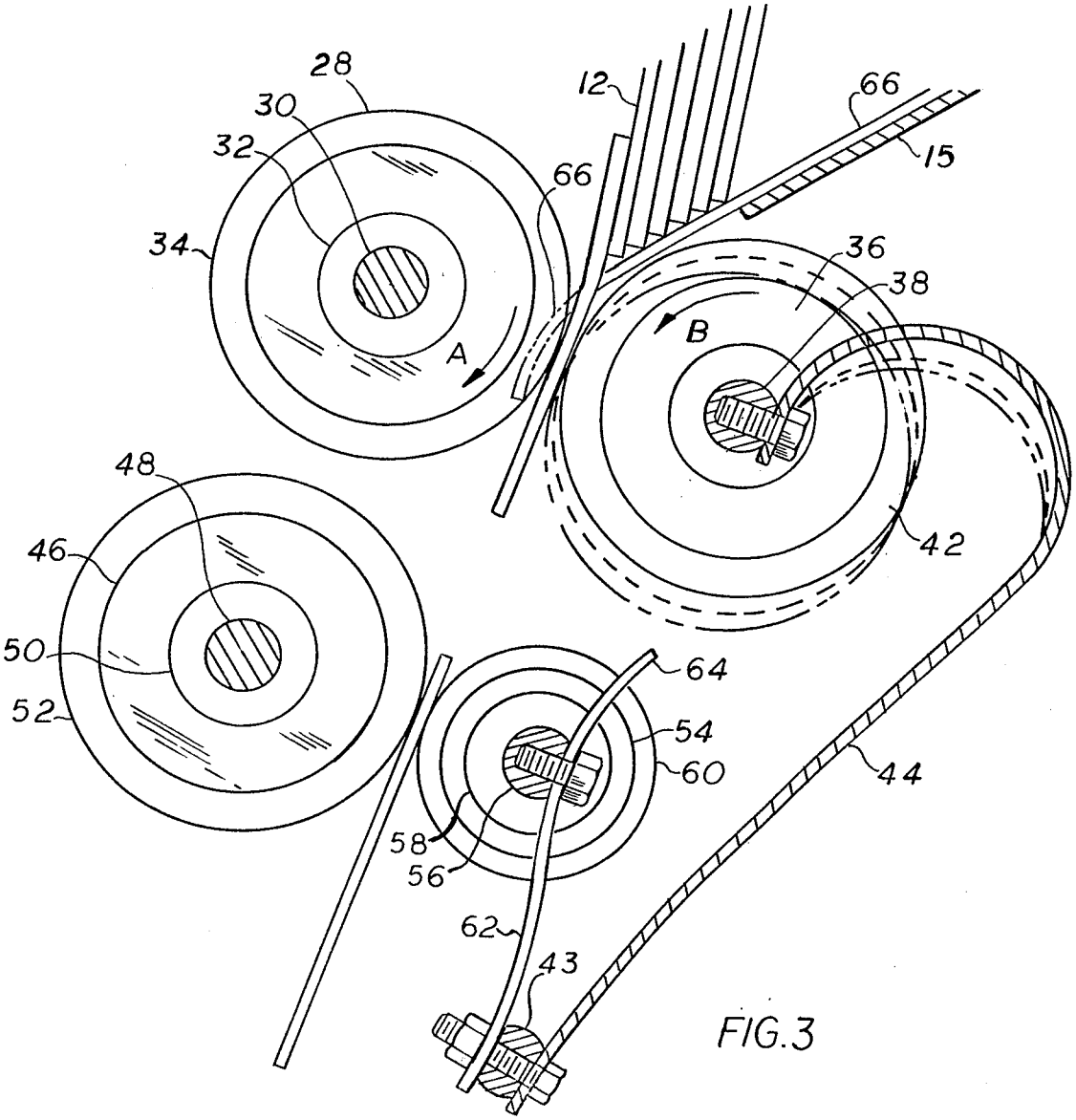
FIG. 3 is an enlarged cross sectional view of the two pairs of drive and driven rollers showing the top driven roller in three positions during its oscillation.

The operation of the improved feeder can best be seen by referring to FIG. 3. When there is not an envelope in the nip, and the driving roller is rotating in the feeding direction shown by arrow "A," the "U" shaped spring 44 forces the driven roller 36 into contact with the driving roller 28. The friction surface 34 of the driving roller 28 engages the friction surface 42 of the driven roller 36. The "U" shaped spring 44 is illustrated by the solid line position shown in FIG. 3 in this initial condition. As the driving roller 28 applies a force against the driven roller 36, the "U" shaped spring 44 starts to flex and moves to the position shown by the dashed line. As the driving roller 28 continues rotating and applying a force to the driven roller 36, the "U" shaped spring 44 assumes its extreme travel position shown as the solid-dashed line position. For the three illustrated conditions described above, the driven roller 36 has been illustrated in a similar manner. The first position of the driven roller is shown by the solid line, the intermediate position by the dashed line, and the third or extreme condition is shown by the solid-dashed line.

When the driven roller 36 assumes the third or extreme position of travel, the force of the "U" shaped spring 44 is greater than the force applied by the driving roller 28 and, the driven roller 36 jumps back to its initial position illustrated by the solid line. In this manner, the driven roller 36 continues to rapidly oscillate between the two extreme travel positions. This oscillation helps to pull the leading envelope 12 from the stack 14.

One or more feed springs 66 support the envelopes 12 as they slide from the hopper 15 towards the nip. The springs 66 apply a slight force against the envelope 12, which pushes the envelope 12 against the driving roller 28. This results in driving roller 28 making positive driving engagement with the envelope 12. When an envelope enters the nip, as shown in FIG. 3, the driven roller 36 will immediately assume the solid line position. The driving roller 28 will transmit an envelope feeding force through the envelope 12 causing the driven roller 36 to rotate in the envelope feed direction shown as arrow "B." The force which is transmitted through the envelope 12 will exceed the brake force applied to the driven roller 36 as long as only a single envelope is within the nip. If two or more envelopes are in the nip, the envelope feeding force will not exceed the brake force and the brake will cause the driven roller 36 to remain stationary while the driving roller 28 will continue feeding the envelope in contact with it. Any additional envelopes will be held motionless against the driven roller 36 until the envelope in contact with the friction surface 34 is fed through the first set of driving rollers and into the second set of rollers.

In practice, it was found that improved envelope separation and feeding occurred by holding the lead envelope 12 in the stack 14 at an angle of $\pm 10$ degrees with respect to a tangential line drawn through the point of contact of the driving roller 28 and driven roller 36 when they are at rest. This results in the envelope 12 being bent a small amount around the driving roller 28. The envelope are thus fed in a straight-through manner. The envelope 12 will not push the driven roller 36 out of engagement with the driving roller 28 without the envelope being in the nip so it will be fed.

Also illustrated in FIG. 3 is the second driving roller 46 and second driven roller 54. These operate similar to the device described in the '926 application. However, the spring 62 has been improved to provide a larger force in the vertical direction which helps in holding larger heavy documents so that they will not accidently fall through the second set of rollers. Also, the second spring 62 permits the second driven roller 54 to oscillate a very small amount similar to the oscillation described above for the first driven roller 36.

Thus, it is apparent that there has been provided, in accordance with the invention an improved document feeder that fully satisfies the objects, aims and advantages set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An improved envelope feeder for feeding envelopes downstream in an envelope feeding direction from a hopper positioned above the feeder comprising:

a driving shaft driven in the envelope feeding direction, a driving roller mounted for rotation on a driven shaft adjacent the driving roller so that the circumferences of the rollers define a nip therebetween, brake means connected to the driven roller for applying a brake force to the roller in a direction opposite the envelope feeding direction, the driving roller in frictional engagement with the envelope during feeding and applying a feeding force to the envelope, the feeding force transmitted to the driven roller being greater than the brake force causing the driven roller to rotate in the envelope feed direction when a single envelope is in the nip, and the brake force being greater than the feeding force transmitted to the driven roller when two or more confronting envelopes are within the nip so that the driven roller remains stationary while the driving roller continues feeding the envelope in contact with it while the driven roller restrains the envelope in contact with it causing one envelope in the nip to be fed at a time, spring means applying a spring force to the driven roller for maintaining the circumference of the driven roller in contact with the circumference of the drive roller when no envelope is in the nip and allowing the rollers to separate, automatically adjusting the nip for variations in envelope thickness, means for causing the driven roller to oscillate between its initial position where it is in contact with the driving roller to a second position where the driven roller is in contact with the driving roller downstream in the envelope feed direction, the oscillation occurring when no envelopes are between and in contact with the rollers and the oscillation stopping when an envelope is between and in contact with the rollers.

2. The document feeder of claim 1, wherein the means for causing oscillation comprises friction surfaces on the circumference of the drive and driven rollers, the spring force maintaining the friction surfaces in contact with each other when no envelope is being fed between the rollers, the feeding force from the drive roller pushing the driven roller in the downstream direction until the spring force applied counter the feeding force exceeds the feeding force causing the driven roller to jump back to its initial position.

3. The device of claim 2 wherein the envelopes are stacked in a vertical plane on their edges in the hopper, the lead envelope in the stack being drawn into the nip by gravity and the oscillation of the driven roller assisting in separating the lead envelope from the stack.

4. The device of claim 3 wherein the envelopes are stacked in a plane which is approximately 5 degrees towards the vertical with respect to a tangential line drawn from the point of contact of the driving and driven rollers when in their initial positions.

5. An improved document feeder for feeding documents downstream in a document feeding direction from a hopper positioned above the feeder comprising:

a driving shaft driven in the document feeding direction, a driving roller mounted for rotation on a driven shaft adjacent the driving roller so that the circumferences of the rollers define a nip therebetween, brake means connected to the driven roller for applying a brake force to the roller in a direction opposite the document feeding direction, the driving roller in frictional engagement with the document during feeding and applying a feeding force to the document, the feeding force transmitted to the driven roller being greater than the brake force causing the driven roller to rotate in the document feed direction when a single document is in the nip, the brake force being greater than the feeding force transmitted to the driven roller when two or more confronting documents are within the nip so that the driven roller remains stationary while the driving roller continues feeding the document in contact with it while the driven roller restrains the document in contact with it causing one document in the nip to be fed at a time, a "U" shaped spring having its arms pointing generally downward with one of the arms mounted to a frame member and the other arm connected to the driven shaft, the "U" shaped spring applying a spring force to the driven roller for maintaining the driven roller in contact with the drive roller when no document is in the nip, and allowing the rollers to automatically separate adjusting the size of the nip for variations in document thickness, the spring force being at a first magnitude when thin documents are fed and at a second, larger magnitude when thick documents are fed.

6. The document feeder of claim 5 wherein the "U" shaped spring causes the driven roller to oscillate between its initial position where it is in contact with the driving roller to a second position where the driven roller is in contact with the driving roller downstream in the envelope feed direction, the oscillation occurring when no documents are in contact with the rollers and the oscillation stopping when a document is in contact with the rollers.

7. The device of claim 6 wherein the documents are stacked in a vertical plane on their edges in the hopper, the lead document in the stack being drawn into the nip by gravity and the oscillation of the driven roller assisting in pulling the lead document from the stack.

8. The device of claim 7 wherein the documents are stacked in a plane which is no greater than 10 degrees with respect to a tangential line drawn from the point of contact of the driving and driven rollers when in their initial, at rest positions.

* * * * *